US005099895A

United States Patent [19]

Loeliger

[11] Patent Number: 5,099,895

[45] **Date of Patent: * Mar. 31, 1992**

[54] FILLING HEAD FOR ASEPTICALLY FILLING A PACK

[75] Inventor: Willi Loeliger, Konolfingen, Switzerland

[73] Assignee: Clintec Nutrition Co., Deerfield, Ill.

[ * ] Notice: The portion of the term of this patent subsequent to Apr. 17, 2007 has been disclaimed.

[21] Appl. No.: 510,455

[22] Filed: Apr. 17, 1990

[30] Foreign Application Priority Data

May 2, 1989 [CH] Switzerland ..... 1667/89-8

[51] Int. Cl.[5] ..... B65B 1/04; B65B 31/00

[52] U.S. Cl. ..... 141/89; 141/85; 141/90; 141/63

[58] Field of Search ..... 141/85, 89, 90, 91, 141/92, 63, 64, 69, 11; 53/167

[56] References Cited

U.S. PATENT DOCUMENTS

| | | | |
|---|---|---|---|
| 4,245,552 | 1/1981 | Small et al. | 99/483 |
| 4,318,431 | 3/1982 | Evans | 141/90 |
| 4,350,187 | 9/1982 | Trusselle et al. | 141/90 |
| 4,414,036 | 11/1983 | Anderson et al. | 134/23 |
| 4,458,734 | 7/1984 | Scholle et al. | 141/5 |
| 4,495,974 | 1/1985 | Pohorski | 141/132 |
| 4,519,184 | 5/1985 | Brunswick | 53/503 |
| 4,524,563 | 6/1985 | Sassi | 53/426 |
| 4,559,961 | 12/1985 | Anderson et al. | 134/166 R |
| 4,605,047 | 8/1986 | Bausch et al. | 141/83 |
| 4,729,204 | 3/1988 | Weiss | 53/88 |
| 4,805,378 | 2/1989 | Anderson | 53/426 |
| 4,893,659 | 1/1990 | Loliger | 53/111 R |
| 4,916,885 | 4/1990 | Loliger | 53/268 |
| 4,942,716 | 7/1990 | Anderson | 53/426 |

FOREIGN PATENT DOCUMENTS

| | | |
|---|---|---|
| 0072699 | 8/1983 | European Pat. Off. . |
| 0236107 | 3/1987 | European Pat. Off. . |
| 0271242 | 6/1988 | European Pat. Off. . |
| 1916636 | 10/1969 | Fed. Rep. of Germany . |
| 1594021 | 6/1970 | France . |
| 2097770 | 11/1982 | United Kingdom . |

*Primary Examiner*—Ernest G. Cusick
*Assistant Examiner*—David J. Walczak
*Attorney, Agent, or Firm*—Vogt & O'Donnell

[57] ABSTRACT

A filling head apparatus for filling a pack aseptically has a steam inlet valve and passage and a steam outlet and emptying valve and passage connected to a filling head space for delivery of sterilizing steam to and for removal of sterilizing steam and residual fluid from the filling head space. The steam inlet and outlet valves and passages are positioned to have longitudinal axes which form an angle of from 70° to 110°. A valve which is displaceable in the filling head controls delivery and regulates the flow of fluid to the filling head space.

7 Claims, 3 Drawing Sheets

FILLING HEAD FOR ASEPTICALLY FILLING A PACK

BACKGROUND OF THE INVENTION

This invention relates to a process for sterilizing and cleaning the head space of an aseptic filling system for a pack provided with a spout comprising an outer tearable membrane. The invention also relates to a device for carrying out this process.

Aseptic filling systems are already known in which a device for sterilizing and cleaning the system after filling is provided at the base of the filling head. European patent application 271 242, for example, relates to one such device.

Using an aseptic filling system, a pre-sterilized pack is filled cold and, after filling, the body and walls of the head space are cooled through the presence of the cold product. After the introduction of another pack, the head space and the surface of the pack resting against it have to be re-sterilized. Now, sterilization is carried out with saturated steam at a temperature in the range from 140° to 150° C. If it were desired to eliminate all the germs at that temperature, the sterilization time would have to be of the order of 3 to 10 minutes. The reason for this is that the saturated steam is unable to bring the cold and continually cooled walls of the head space to the necessary temperature for inactivating the heat-stable germs. These walls actually remain at a temperature of the order of 120° to 125° C. Elimination of the heat-stable germs cannot be guaranteed at that temperature. In any event, it would be totally unthinkable in economic terms to carry out sterilization for such a long period. Sterilization has to be completed in less than 10 seconds.

In addition, if the head space were heated at an excessively high temperature for too long, the outer tearable membrane and the spout would soften and deform, which would be unacceptable for the rest of the process. On the other hand, in the patent application cited above, the steam inlet valve and the steam outlet and emptying valve are arranged opposite one another. Now, experience has shown that an arrangement such as this does not enable all the residues of product in the spout to be fully removed in an acceptable time during cleaning or rinsing of the interior of the spout after filling.

SUMMARY OF THE INVENTION

The object of the present invention is to develop a device for sterilizing and cleaning the head space of an aseptic filling system which provides for complete sterilization of the head space in an acceptable time and at an acceptable temperature and for cleaning of the interior of the spout after filling so that all residues of product are removed. This removal is important because if traces of product were to remain in the spout in contact with a non-sterile environment, reinfection and proliferation of the germs would be possible. When the pack is opened and used, these germs would be entrained with the product flowing through the spout.

The invention relates to a process for sterilizing and cleaning the head space of an aseptic filling system for a sterile pack provided with a spout with an outer tearable membrane, in which the head space is sterilized with steam arriving at a rate of 50 to 450 m/sec for 1 to 10 seconds at a temperature of 120° to 150° C., the outer membrane is torn to fill the pack, the pack is closed and the head space is cleaned for 1 to 5 seconds with steam at a temperature of 110° to 150° C. arriving at a rate of 50 to 450 m/sec. The arrival of steam at the rate mentioned above is achieved through an expansion of pressure of the order of 2 to 3 atmospheres.

It has in fact been found that rinsing with steam enables the germs present to be eliminated and the higher the turbulence of the steam in the headspace, this elimination is better. Accordingly, the invention provides for sterilization, on the one hand, by the stripping of germs with steam arriving at high speed and, on the other hand, by inactivation of the germs by the high stream temperature. The same observation may be made with regard to the rinsing with steam after filling.

The head space is thus sterilized in less than 10 seconds while the spout with the outer torn membrane is rinsed in less than 5 seconds.

If saturated steam at a temperature of 120° to 130° C. arriving at a rate of 50 to 150 m/sec. is used, effective sterilization and rinsing of the spout is also obtained. If the level of contamination is equivalent to $10^5$ germs, less than 1 germ is left after less than 10 seconds under the conditions according to the invention.

The quantity of steam introduced depends on the diameters of the inlet pipes. It is normally between 3 and 10 g/sec.

The invention also relates to a device comprising a fluid inlet and outlet pipe, a filling head, a support for the pack arranged beneath the filling head and designated to seal the pack after filling, the filling head comprising a valve to regulate the fluid entry rate.

The device according to the invention comprises a steam inlet valve and passage and a steam outlet valve and passage for cleaning after filling which are arranged at the base of the filling head and of which the axes form an angle of 70° to 110° with one another.

It has been found that introduction and removal of the steam at this angle in the head space enables stertilization and cleaning of the spout to be maximized. The expression "at the base of the filling head" is understood to mean the part nearest the spout with the tearable membrane.

DETAILED DESCRIPTION OF THE INVENTION

In the context of the invention, the term "pack" is understood to encompass both plastic packs and cardboard packs or any other type of pack for food or medical products. The term "fluid" is understood to include both aqueous solutions and milk, fruit or vegetable juices or more viscous products, such as jam, marmalade and the like, with or without pieces. The pack support consists of jaws to hold the pack in place and a sealing head.

Before filling, the filling head space and the outer surface of the tearable membrane are sterilized. This is done by means of the steam inlet valve and passage. The other valve and passage are used on the one hand for the removal of steam during sterilization and, on the other hand, for the removal of residual fluid after filling. The fluid inlet and outlet pipe are, of course, also sterilized before filling.

In one preferred embodiment, the axis of the steam inlet valve and passage and the axis of the steam outlet valve and passage form an angle of 85° to 95°.

This sterilizing and cleaning system may be used on any type of aseptic filling head operating with a pack provided with a spout comprising an outer tearable membrane, for example those described in Swiss patent application 4585/87-5 and in European patent application 280 871.

In the device according to the invention, the axis of the valve for regulating the fluid entry rate and the axis of the steam inlet valve and passage form an angle of 40° to 80° and preferably of the order of 60° to 70°.

The base of the valve for regulating the fluid entry rate also comprises cutting means. This cutting means are normally radial and vertical blades, for example two blades arranged perpendicularly.

The pin of the steam inlet valve and the pin of the steam outlet and emptying valve are flush in the head space, and the passages and pins of the steam inlet valve and steam outlet and emptying valve have different diameters. The first factor thus helps to avoid any dead zone in the head space which could give rise to microbial growth while the differences in diameter helps to avoid any deceleration of the steam during sterilization and/or cleaning. The diameter of the steam inlet passage must be smaller than that of the steam outlet and emptying passage.

Finally, a removable plate with concentric grooves to hold the pack firmly in position is provided at the base of the filling head. This plate may thus be replaced when it is worn.

It is possible by means of the device according to the invention to construct an entire aseptic filling line in which at least two of the devices described above are arranged in series. Between two and eight filling devices are preferably provided.

BRIEF DESCRIPTION OF THE DRAWINGS

The invention is described in more detail with reference to the accompanying drawings.

DETAILED DESCRIPTION OF THE DRAWINGS

Figure 1:
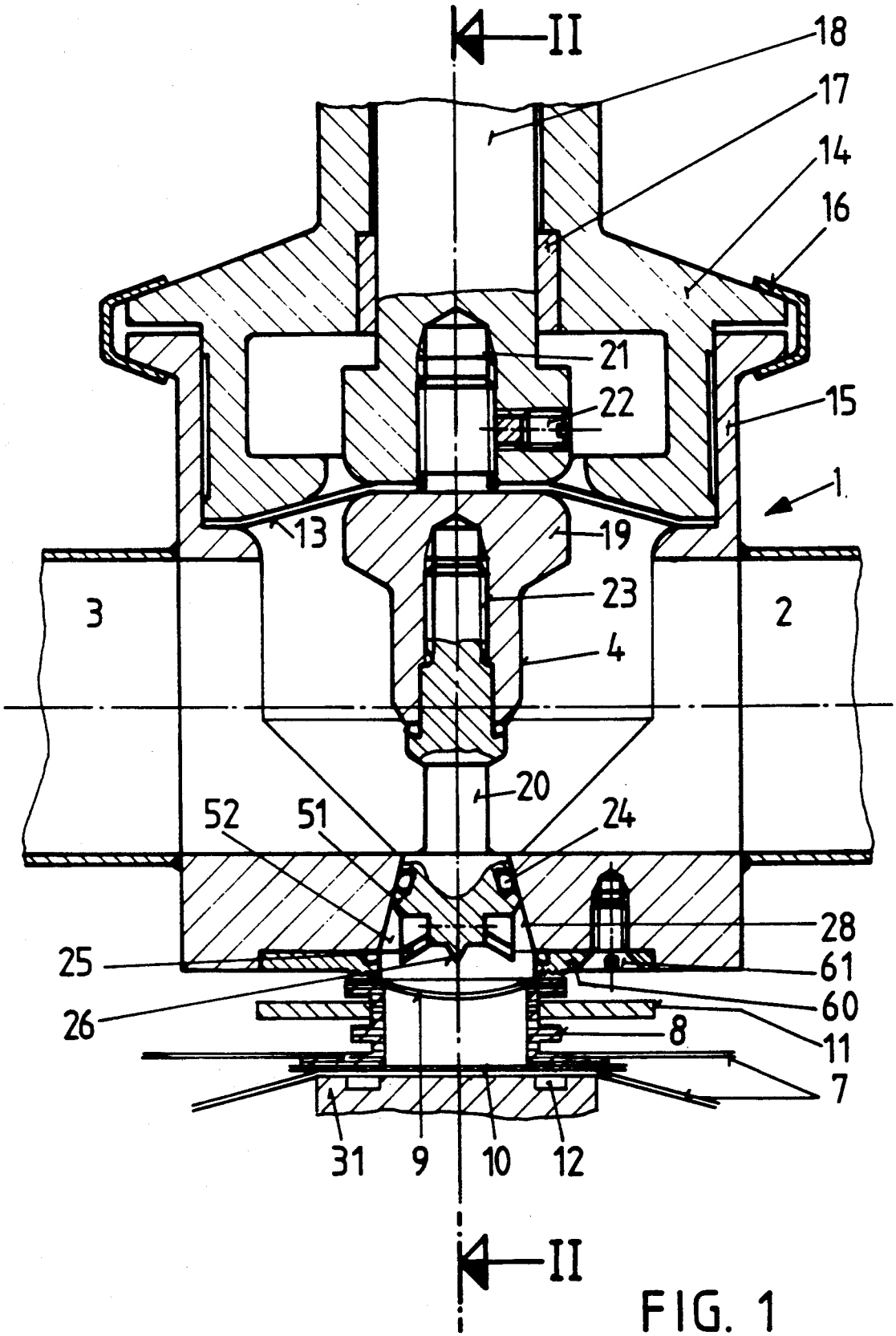
FIG. 1 is a section through the device according to the invention, the fluid inlet valve being closed.

The filling head denoted by the reference (1) comprises a fluid inlet pipe (2) and outlet pipe (3), a valve (4) for regulating the fluid arrival rate, a steam inlet valve (62) and a steam outlet valve (63) through which residual fluid is also emptied. The pins of the valves (62) and (63) are designed for displacement by pneumatic or similar systems (not shown).

Figure 3:
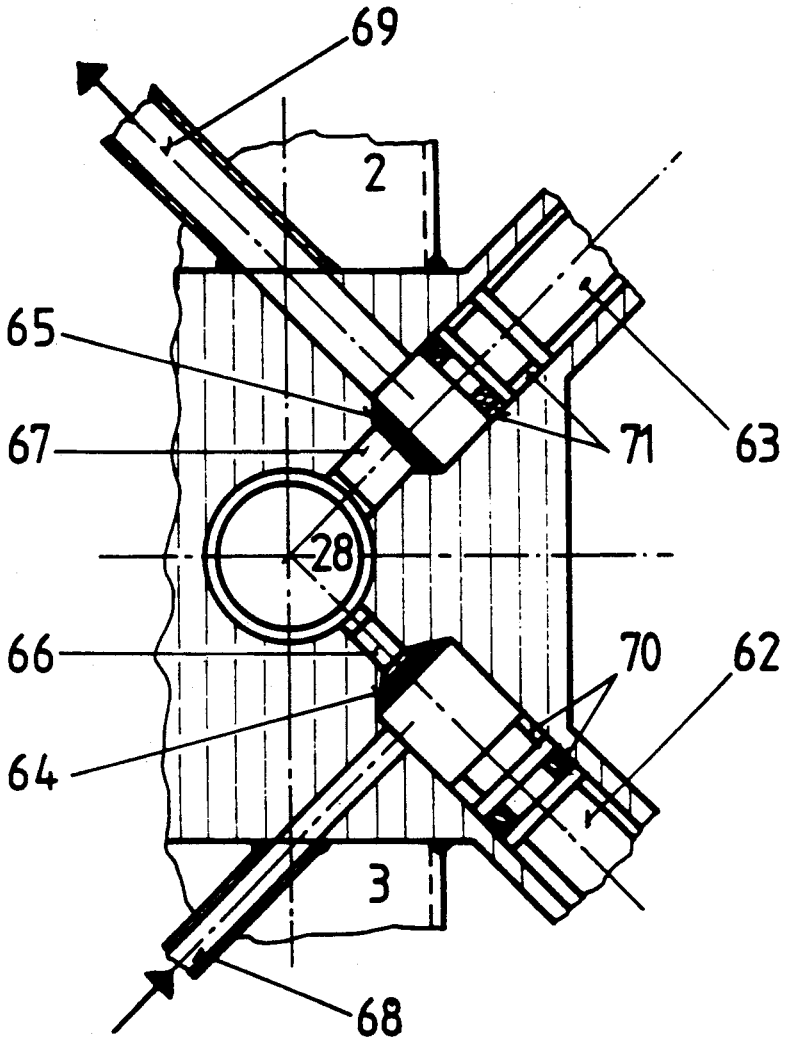
FIG. 3 is a section on the line III—III of FIG. 2.

As can be seen in FIG. 3, the steam inlet valve (62) rests on a seat (64) and has an elongated steam inlet passage (66) smaller in diameter than the elongated steam outlet passage (67) of the steam outlet valve (63). This valve rests on a seat (65). The valves are connected to the filling head space at openings in the filling head space (52).

In this configuration, the two valves each have a longitudinal axis (62) and (63) which form an angle of 90° which provides for effective sterilization and cleaning of the head space. Finally, the two valves (62) and (63) respectively comprise seals (70) and (71).

Positioned beneath the actual filling head is a pack (7) comprising a spout (8) with a tearable membrane (9) and a closure membrane (10) partly seal against the spout (8) to allow filling. The pack is held in place by jaws (11) beneath which is arranged the sealing head (31) by which the pack is closed after filling. The sealing head comprises a sealing ring (12).

The filling head comprises a flexible membrane (13) gripped between the two parts (14,15) of the filling head housing which are held firmly together by the locking ring (16). The flexible membrane may be made of polytetrafluoroethylene, rubber or any other flexible material of high mechanical and thermal stability. The regulating valve (4) is designed for vertical displacement between bushes (17) by means of pneumatic or similar systems (not shown).

The membrane (13) has a hole at its center through which the regulating valve (4) extends. The regulating valve 4 consists of three parts, namely: the upper part (18) into which the part (19) is screwed with the bolt (21), thus ensuring firm gripping of the flexible membrane (13). The locking screw (22) holds the membrane (13) in place and keeps it fluidtight. Finally, the regulating valve comprises a lower part (20) which is screwed into the part (19) by means of the bolt (23). The lower part (20) of regulating valve, which comprises a cone (51), provides for opening/closing the headspace (52) for filling the pack. It comprises a seal (24) and two perpendicularly arranged blades (25). These blades form a central point (26) which enables cutting of the membrane (9) to be further improved. In order further to improve holding of the membrane (9), a removable plate (60) is provided, being held in place by screws (61) and comprising concentric grooves. The opening (28) in the head space (52) for the passage of fluid is frustoconical in shape. This opening also forms the seat for the cone (51).

Figure 2:
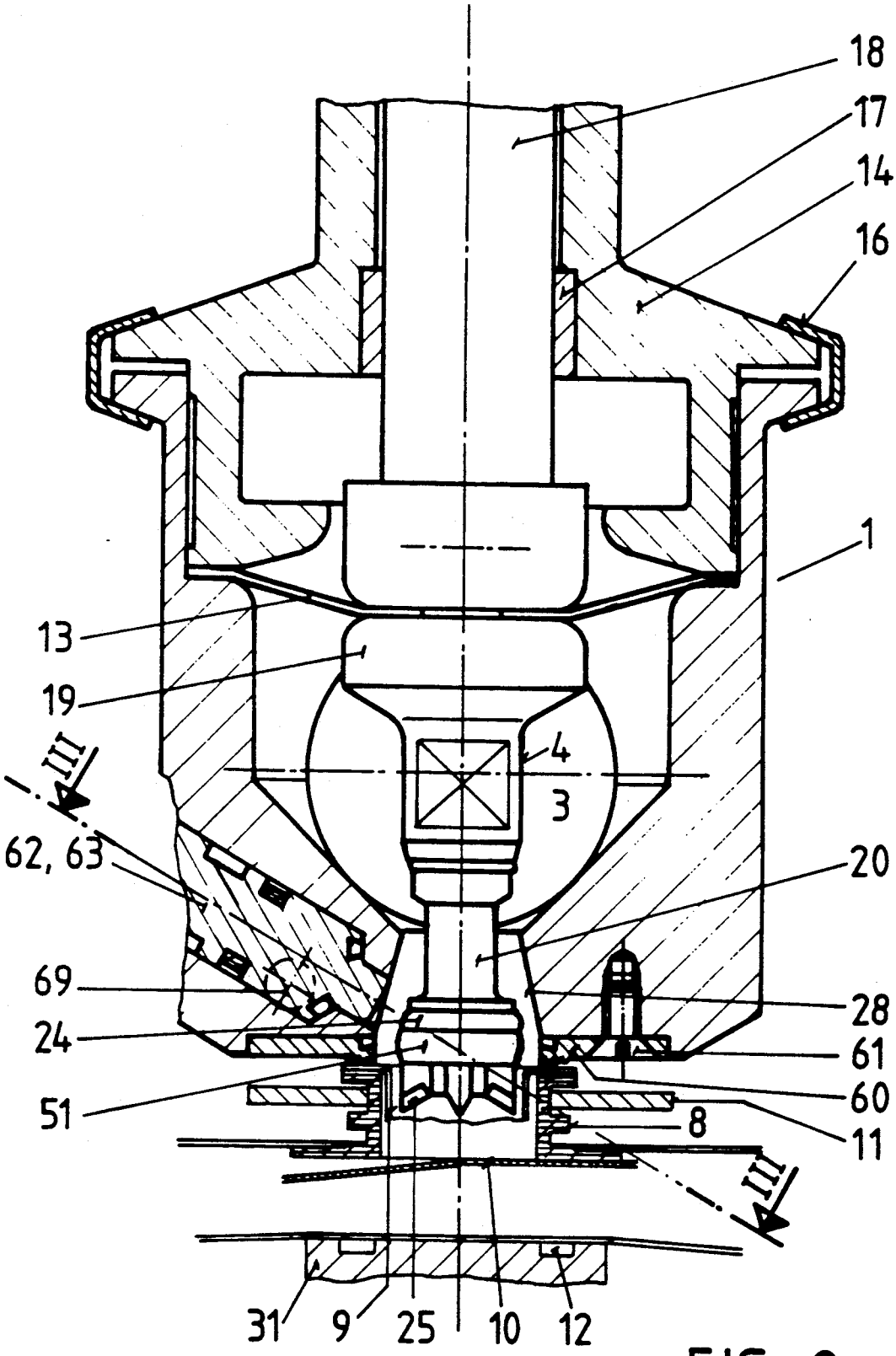
FIG. 2 is a partial section on the line II—II of FIG. 1, the fluid inlet valve being open.

The device operates as follows:

With the regulating valve (4) closed (FIG. 1) and the pack (7) in position, the head space (52) and the membrane (9) are sterilized by opening of the steam inlet valve (62). The steam arrives through the pipe (68) and leaves through the pipe (69) of the steam outlet and emptying valve (63). After sterilization, the two valves (62) and (63) are closed and the regulating valve (4) is opened (FIG. 2). The element (20) descends and the blades (25) open the tearable membrane (9). At the same time, the fluid is released and enters the pack (7) through the opening (28). The sealing head (31) is of course in its lower position during filling. After filling, the sealing head rises, the valves (62) and (63) are opened so that the steam drives out the residual product which flows out through the pipe (69). During or after this cleaning operation, the sealing ring (12) is heated, thus closing the pack (7). The jaws (11) may now release the pack.

I claim:

1. An apparatus for aseptically filling a pack comprising:

a filling head housing having walls encompassing and defining a filling head space which has a first portion for receiving fluid to be filled in a pack, a second portion displaced from the first position for delivering the fluid to a pack and accommodating an elongated steam inlet passage for sterilization of the filling head space and an elongated steam outlet and emptying passage for removal of residual fluid from the filling head space, wherein each passage terminates in an opening in the housing walls adjacent the second portion of the filling head space, wherein the longitudinal axes of the passages at their openings form an angle therebetween of from 70 degrees to 100 degrees and wherein the steam outlet and emptying passage has a larger cross-section than the steam inlet passage;

a steam inlet valve positioned within the steam inlet passage for controlling sterilization of the filling head space and a steam outlet and emptying passage valve for controlling removal of residual fluid from the filling head space;

an elongated regulating valve which is positioned and displaceable within and which extends through the filling head housing and terminates in a cutting means for cutting a tearable membrane of a pack to be filled and which includes an opening and closure element for opening and closing the filling head space to the flow of fluid for controlling the delivery and regulating the flow rate of fluid into the filling head space and for enabling filling of a pack with fluid; and a fluid inlet and outlet pipe connected to the first portion of the filling head space for delivering fluid to the filling head space via the regulating valve opening and closure element and for passing on fluid not delivered to the filling head space by the regulating valve opening an closure element to the filling head space.

2. An apparatus according to claim 1 wherein the longitudinal axis of the steam inlet passage and the longitudinal axis of the steam outlet passage form an angle of from 85° to 95°.

3. An apparatus according to claim 1 wherein the longitudinal axis of the regulating valve and the longitudinal axis of the steam inlet passage form an angle of from 40° to 80°.

4. An apparatus according to claim 1 further comprising a pack support for holding the pack adjacent the filling head space for filling the pack and a sealing head for sealing the pack after filling.

5. An apparatus according to claim 4 wherein the filling head space further comprises a removable plate having concentric grooves positioned above the pack support.

6. An apparatus according to claim 1 wherein the filling head space is frustoconical in shape and the valve opening and closure element is a cone.

7. An apparatus according to claim 1 further comprising a flexible membrane in contact with an upper portion of the regulating valve.

* * * * *